United States Patent [19]

Jaquay et al.

[11] 4,436,611

[45] Mar. 13, 1984

[54] PROCESS FOR HEATING RECYCLE GAS IN OIL SHALE RETORTING

[75] Inventors: Louis H. Jaquay, Pittsburgh; Mark Venetti, Bethel Park, both of Pa.

[73] Assignee: Dravo Corporation, Pittsburgh, Pa.

[21] Appl. No.: 510,291

[22] Filed: Jul. 1, 1983

[51] Int. Cl.[3] ..... C10G 1/02; C10B 49/02; C10B 53/06

[52] U.S. Cl. ..... 208/11 R; 201/29; 201/34; 201/13

[58] Field of Search ..... 208/11 R; 201/13, 14, 201/28, 32, 34, 37, 40, 29

[56] References Cited

U.S. PATENT DOCUMENTS

| | | | |
|---|---|---|---|
| 2,752,292 | 6/1956 | Scott, Jr. | 201/29 X |
| 2,814,587 | 11/1957 | Van Dijck | 208/11 R |
| 2,982,701 | 5/1961 | Scott, Jr. | 208/11 R |
| 3,318,798 | 5/1967 | Kondis et al. | 201/34 X |
| 3,331,754 | 7/1967 | Mansfield | 201/28 |
| 3,384,569 | 5/1968 | Peet | 208/11 R |
| 3,503,869 | 3/1970 | Haddad et al. | 201/29 X |
| 3,520,795 | 7/1970 | Schulman et al. | 201/29 X |
| 3,526,586 | 9/1970 | Saxton | 208/11 R |
| 3,617,468 | 11/1971 | Reyburn et al. | 208/11 P |
| 3,619,405 | 11/1971 | Smith | 208/11 R |
| 3,634,225 | 1/1972 | Garbett | 201/28 X |
| 4,092,237 | 5/1978 | Reed | 208/11 R |
| 4,161,442 | 7/1979 | Auden et al. | 208/11 R |
| 4,297,201 | 10/1981 | Jones et al. | 201/29 X |
| 4,388,174 | 6/1983 | Magedanz et al. | 201/32 X |

*Primary Examiner*—Delbert E. Gantz
*Assistant Examiner*—Glenn A. Caldarola
*Attorney, Agent, or Firm*—Parmelee, Miller, Welsh & Kratz

[57] ABSTRACT

Recycle gas for the indirect retorting of oil shale, is heated after the oil has been recovered from the gas, utilizing the residual carbon in hot oil depleted shale. The hot oil depleted shale is charged into a vertical shaft furnace where it is combusted by the introduction of air into the upper portion of the furnace. The heat so generated is recovered from the lower part of the furnace for heating the recycle gas and cooling the spent shale. A portion of the coarse fraction of the cooled spent shale discharged from the bottom of the furnace is recycled to the top to regulate the temperature of combustion. The recycle gas may be heated directly by countercurrent contact with the hot, spent shale in the lower portion of the furnace or indirectly in a heat exchanger by an inert gas which is circulated through the lower portion of the furnace. The gaseous products of stoichiometric combustion of the residual carbon from the upper part of the furnace are withdrawn at an intermediate level with, and as a component of, the recycle or inert gas withdrawn from the bottom of the furnace.

10 Claims, 2 Drawing Figures

PROCESS FOR HEATING RECYCLE GAS IN OIL SHALE RETORTING

BACKGROUND OF THE INVENTION

1. Field of the Invention

The invention is directed to a process and apparatus for heating the process recycle gas utilized in the indirect retorting of oil shale, and more particularly, to a process and apparatus for the combustion of residual carbon in the oil depleted shale to heat the process gas and the recycling of cooled spent shale to moderate the temperature of combustion.

2. Description of the Prior Art

One method of employing a traveling grate retort for processing fresh oil shale requires the circulation of an inert gas through the burden of shale on the grate. Heat is either directly or indirectly provided to recover the oil from oil shale. Vaporized oil from the shale is entrained by the inert gas which is, in turn, conveyed to an oil recovery system. The oil free recycle gas is returned to the traveling grate.

In the direct method of retorting, sufficient oxygen containing air is injected into part of the bed to burn combustible material in the shale, thus raising the temperature of the gas and shale above the oil eduction temperature. The hot gas leaving the shale bed is cooled in heat exchangers to recover the oil before being recycled. The hot spent shale is cooled by the continuous circulation of recycle gas therethrough.

In the indirect method of heating the shale oil burden, an inert gas is heated externally and circulated through the burden to recover the oil. In both the direct and indirect methods of heating, most of the organic carbon produced in the decomposition of the kerogen remains in the spent shale.

It has been suggested that the residual carbon in the spent shale be utilized for the generation of thermal energy. In U.S. Pat. No. 2,434,815, the carbon remaining in spent shale is burned in a vertical shaft furnace, where steam is produced. The steam is used to recover oil from shale. U.S. Pat. No. 2,752,292 teaches the combination of a horizontal conveyor and a vertical retort for recovering oil from shale. In U.S. Pat. No. 4,039,427, oil depleted material containing uncombusted carbons and hydrocarbons is combusted on a separate traveling grate. The combusted hot spent shale is used as a heat source for fresh shale.

In U.S. Pat. No. 4,297,201 the residual carbon in indirectly retorted shale is burned out as the oil depleted shale descends through a vertical kiln which is separate from the retort vessel. Combustion is supported by air flowing countercurrently to the shale with the temperature of combustion controlled by the injection of an inert gas with the air. Additional inert gas is fed into the bottom of the kiln to absorb the heat generated by the combustion process. All of the hot gases are recovered from the top of the vertical kiln and passed through a heat exchanger to heat the process gas used in indirect retorting additional oil shale before being recirculated as the inert gas.

SUMMARY OF THE INVENTION

The invention is directed to a process and apparatus for heating recycle gas for the indirect retorting of oil from fresh oil shale. After the liberated oil is recovered from the recycle gas, the gas is heated utilizing the heat generated by the combustion of the residual carbon in the oil depleted shale. Hot oil depleted shale is charged into the top of a vertical shaft furnace with sufficient air to effect the combustion of the residual carbon in the oil depleted shale in the upper portion of the shaft furnace and thereby generate heat energy and hot spent shale. The heat energy is recovered from the hot spent shale in the lower portion of the furnace to heat the recycle gas and cool the spent shale. At least a portion of the cooled, combusted spent shale from the bottom of the vertical shaft furnace is recycled to the upper portion thereof to moderate the temperature of combustion through heat absorption. The cooled, spent shale, which consists of a "coarse" and a fine fraction, is preferably screened with only the coarse fraction being returned to the top of the furnace. This improves the permeability of the burden. It is better yet to charge the furnace alternately with hot oil depleted shale and then coarse cooled spent shale so that separate layers of the two materials are formed. This provides for better combustion of the residual carbon in the hot oil depleted shale and also improves the overall permeability of the combined burden.

The recycle gas can be heated either directly or indirectly by the hot oil depleted shale which has been further heated by the combustion of its residual carbon content. In the direct method, the recycle gas which has been substantially cleansed of liberated shale oil, is fed into the bottom of the vertical shaft furnace for ascendant passage in countercurrent contact with the hot spent shale. The heated recycle gas from the bottom portion of the furnace and the combustion gases from the upper portion are withdrawn from the furnace at an intermediate portion for use as hot recycle gas for indirect retorting of fresh oil shale.

For indirect heating of the substantially oil free recycle gas, a cool, inert gas is introduced into the bottom of the vertical shaft furnace for ascendant passage in countercurrent contact with the hot spent shale. The heated inert gas and the combustion gases are withdrawn from the furnace at an intermediate level and circulate through one side of heat exchanger means where they are cooled to form the cool inert gas. The oil free recycle gas is heated as it passes through the other side of the heat exchanger means. Some of the cooled inert gas can be further cooled for use, for instance, as sealing gas in a traveling grate retort, by passing it through second heat exchanger means which heats the oxygen containing gas before it is introduced into the top of the furnace.

It is an object of this invention to isolate the combustion of carbon from the decomposition of the oil shale so that only carbon is burned to produce the required process energy.

It is an additional object of this invention to increase the productive capacity of the traveling grate by eliminating the cooling period of the hot spent shale on the grate.

BRIEF DESCRIPTION OF THE DRAWINGS

The above as well as other features and advantages of this invention will become apparent through consideration of the detailed description in connection with the accompanying drawings in which.

DETAILED DESCRIPTION OF THE INVENTION

Figure 1:
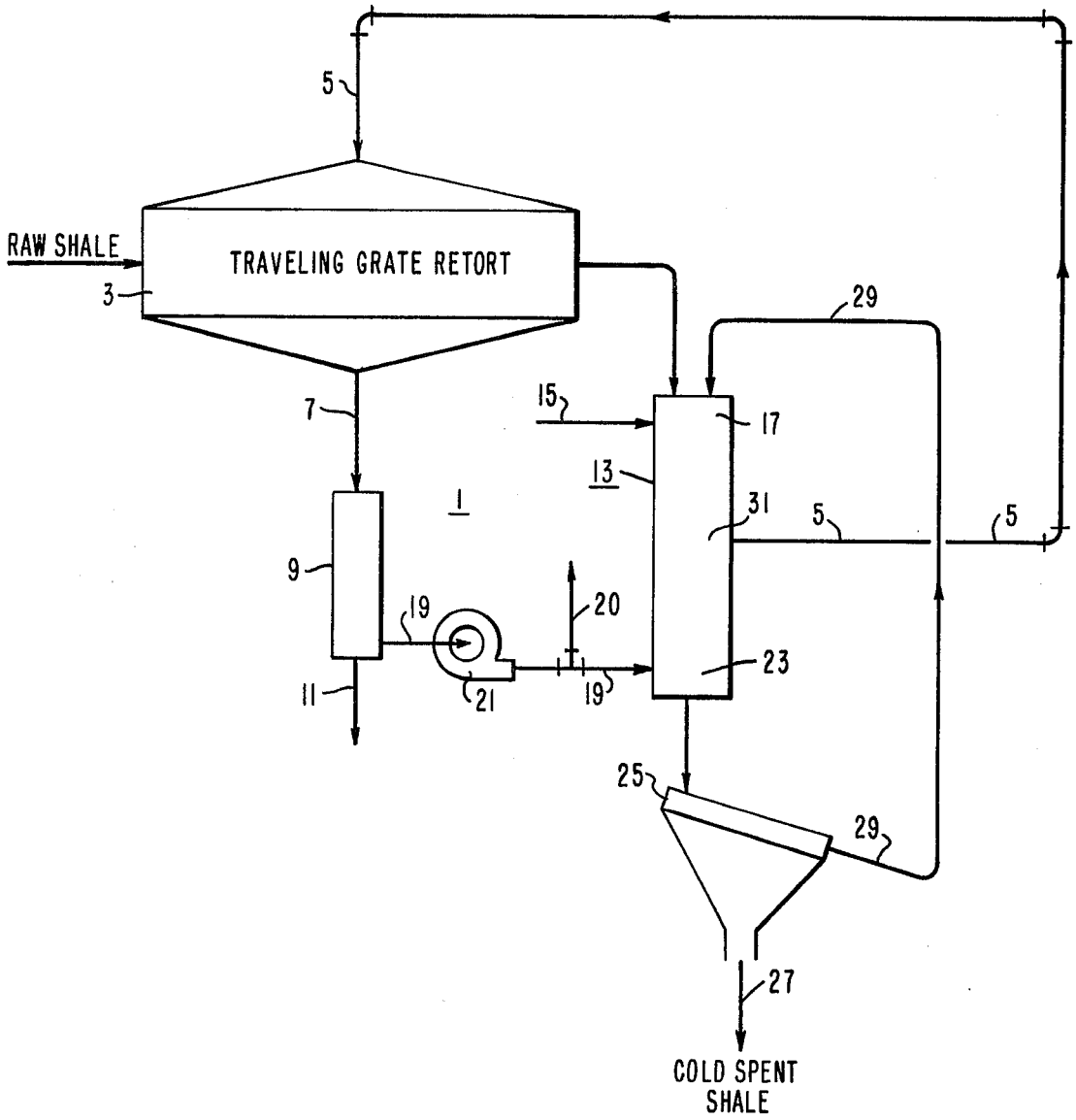
FIG. 1 is a schematic diagram of a process and apparatus for carrying out the invention wherein the recycle gas is heated by direct contact with combusted spent shale.

A first embodiment of the invention is schematically illustrated in FIG. 1 by a system, indicated by the reference character 1, which includes a traveling grate retort 3 to indirectly liberate oil from fresh oil shale. The traveling grate retort can be circular or straight in design and includes several processing zones such as preheating and retorting zones. Fresh shale is charged onto the grate 3, is conveyed through the several zones to liberate the oil and is discharged as hot oil depleted shale. Heretofore it has been typical to provide a cooling zone in the traveling grate retort, in which the hot oil depleted shale is cooled prior to discharge. Because the instant process utilizes the hot oil depleted shale substantially immediately after the retorting of oil is effected, the cooling zone in the traveling grate is eliminated. The grate area gained thereby can be utilized to increase the productive capacity of the traveling grate retort.

Based on a processing rate of approximately 2000 pounds of 25 gallon per ton fresh shale per hour, and a heat of decomposition of fresh shale of 353 BTU/lb., about 43000 SCF of recycle gas at a temperature of about 1200° F. is required to effect shale decomposition. The flow of 1200° F. recycle gas containing little or no oxygen enters the grate-retort 3 through line 5 and passes down through the bed of fresh shale. This gas leaves the grate at an average temperature of about 500° F. and contains the hydrocarbons produced by the decomposition of the fresh shale. The recycle gas and hydrocarbons pass through line 7 into a heat exchanger means 9 where the recycle gas is cooled to about 120° F. About 190 pounds of oil is recovered in the heat exchanger means 9 and together with the minor component of water is discharged through line 11.

About 1813 pounds of decomposed or oil depleted shale is discharged from the retorting zone of the grate 3 and is conveyed to the top of a vertical shaft furnace 13 for descending passage therethrough. sufficient oxygen containing gas, such as air, is provided to the furnace 13 through line 15 to effect the combustion of the residual carbon in the hot oil depleted shale while the shale is in the upper portion 17 of the furnace 13. The heat generated by the combustion process further heats the oil depleted shale.

About 40000 SCF of recycle gas, cooled to about 120° F. in the heat exchanger means 9 is recovered therefrom, and is introduced into the bottom of the furnace 13 by line 19. A blower 21 may be provided where convenient to facilitate the recycle gas flow. Exhaust means 20 may also be provided to dispose of excess gas. The recycle gas flows upwardly through the furnace 13 where it countercurrently contacts, in the lower portion 23 of the furnace 13, a descending column of spent shale which has been heated by the combustion of a substantial portion of the residual carbon therein. The countercurrent contact serves to heat the gas to about 1200° F. and cool the spent shale to about 200° F.

The temperature of the oil depleted shale in the upper portion 17 of the furnace during combustion of residual carbon should be controlled to prevent the undesirable decomposition of its calcium and magnesium carbonates. The decomposition of these components is an endothermic reaction which would cause a significant energy loss. Accordingly, it is preferred that the temperature of the combusting residual carbon be maintained at or below about 1200° F. To effect temperature control, a sufficient amount of cooled, spent shale discharged from the bottom of the furnace 3 is returned to the top of the furnace where it combines with the hot oil depleted shale from the grate to limit the peak temperature of combustion. Preferably, the cooled shale discharged from the furnace 3 is first screened by a sizing means 25. The fine fraction is removed through line 27 and only the coarse fraction is returned to the furnace as at 29. The gas flow characteristics of the shale bed in the furnace are enhanced by the use of only the coarse fraction. For the purpose of this invention, it has been found that a sufficiently coarse fraction of shale is available for recycle when the discharged shale is screened at +one inch. Accordingly, as used herein, coarse fraction indicates material not passing through the aforesaid sizing means. The permeability of the bed and combustion of the residual carbon can be further enhanced by alternately charging the hot, oil depleted shale and cooled, spent shale into the top of the furnace to form alternating layers of the two materials.

The products of combustion from the upper portion of the furnace meet the heated recycle gas from the lower portion thereof and are recovered from the furnace at approximately the middle portion 31 thereof. The heated recycle gas and combustion products now at a temperature of about 1100° F. are returned to the traveling grate retort 3 by line 5.

Figure 2:
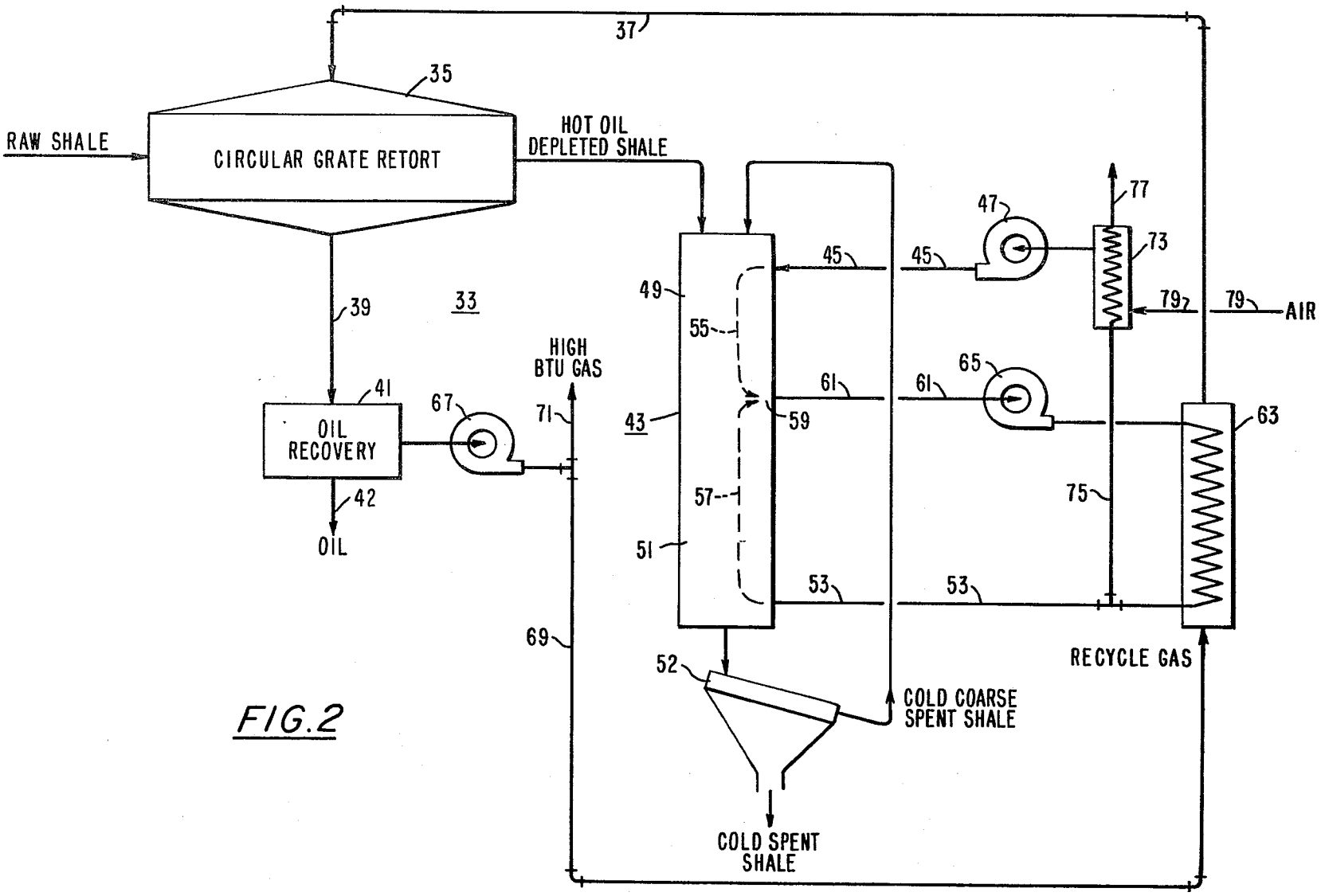
FIG. 2 is a schematic diagram of a process and apparatus for carrying out the invention wherein the recycle gas is heated indirectly in a heat exchanger by an inert gas which is circulated through the combusted spent shale.

A second embodiment of the invention in which the recycle gas is heated indirectly is shown schematically in FIG. 2. This system, identified by the general reference character 33, includes a traveling grate retort 35 similar to the grate 3 utilized in the embodiment of FIG. 1. As in the case of the retort 3, externally heated recycle gas at a termperature sufficient to liberate oil, but not high enough to decompose carbonates, (eg. about 1100° to 1200° F.) is passed through fresh oil shale as it travels along the grate 35. Using the same processing rate of 2000 pounds of 25 gallon per ton fresh shale per hour, and a heat of decomposition of fresh shale requiring 33 BTU/lb. when contacted with inert recycle gas at a temperature of about 1100° F., about 28000 SCF of recycle gas is supplied to the grate machine 35 through line 37 to liberate the oil. The oil ladened gas at a temperature of about 500° F. passes from the grate machine 35 through line 39 to a heat exchanger 41 where it is cooled to about 120° F. The approximately 190 pounds of oil recovered in the heat exchanger 41 is discharged through line 42.

About 1813 pounds of hot oil depleted shale discharged from the traveling grate 35 is charged into the top of a vertical shaft furnace 43. The hot oil depleted shale passes downward through the vertical shaft furnace and is discharged at the bottom. A gas containing a sufficient amount of oxygen to meet the requirements for stoichiometric combustion of the residual carbon in the hot, oil depleted shale is also fed into the top of the furnace 43 through line 45 by blower 47. For the example given, 7300 SCF of air meet these requirements. The air passes downward concurrent with the downward passage of the hot, oil depleted shale to effect combustion of the residual carbon in the upper portion 49 of the furnace 43.

As the hot oil depleted, and now carbon depleted, spent shale descends through the lower portion 51 of the furnace 43, it is cooled by an inert gas which is introduced into the bottom of the furnace through a line 53. About 26000 SCF of cool inert gas flows upward through the lower portion 51 of the furnace in countercurrent contact with the hot, spent shale resulting in heating of the inert gas to a temperature of about 1200° F. and cooling of the spent shale to about 200° F.

Again the temperature of combustion of the residual carbon in the oil depleted shale in the upper portion 49 of the furnace is controlled to about 1200° F. by the recycling of 1830 pounds of the cooled spent shale discharged from the bottom of the furnace. Preferably, the cooled spent shale is classified by screen 52 with only the coarse fraction being recycled. As previously mentioned, the recycled cooled spent shale and the hot, oil depleted shale from the traveling grate retort may be fed alternately into the top of the furnace 43 to form alternating layers of the two materials which further enhances performance of the system.

As indicated by the dotted lines 55 and 57 respectively in FIG. 2, the downwardly flowing gaseous products of combustion of the residual carbon from the upper portion 49 of the furnace and the upwardly flowing heated inert gas from the lower portion 51 are withdrawn at an intermediate level 59 of the furnace through a line 61. About 33000 SCF of these gases at an average temperature of about 1250° F. are circulated through one side of a heat exchanger 63 by a suitably located blower 65. About 28000 SCF of oil free recycle gas from the oil recovery heat exchanger 41 is supplied to the other side of heat exchanger 63 by a blower 67 through line 69 with excess high BTU gas being discharged from the system through line 71. In the heat exchanger 63, the recycle gas is heated to about 1200° F. for return to the traveling grate retort 35 through line 37 to liberate oil from additional oil shale. The combustion gases and hot inert gas from the furnace are cooled in the heat exchanger 63 to about 200° F. and returned to the bottom of the furnace through line 53 as cooled, inert gas.

About 7300 SCF of cooled, inert gas from heat exchanger 63 is excess which is introduced into one side of an additional heat exchanger 73 through line 75 where it is further cooled to about 120° F. and is available at line 77 for other purposes such as sealing gas for the traveling grate retort 35. The oxygen containing gas which is fed into the top of the furnace is drawn from line 79 through the center side of heat exchanger 73 where it is preheated to about 175° F.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A process for heating recycle gas for the indirect retorting of oil from fresh oil shale after the oil has been removed from the recycle gas, utilizing the residual carbon in hot oil depleted shale, said process comprising the steps of:

charging hot, oil depleted shale into the top of a vertical shaft furnace for descending passage therethrough;

supplying sufficient oxygen containing gas to said vertical shaft furnace for the combustion of the residual carbon in said hot, oil depleted shale in the upper portion of said vertical shaft furnace to generate hot spent shale, combustion gases and heat energy which is absorbed by the hot spent shale;

recovering the heat energy from said hot, spent shale in the lower portion of said shaft furnace for heating said recycle gas and for cooling said spent shale; and returning at least a portion of the cooled spent shale from the bottom of said vertical shaft furnace to the top thereof for heat absorption during the combustion of the carbon content of the oil depleted shale in order to moderate the temperature of combustion.

2. The process of claim 1 wherein the cooled, spent shale consists of a coarse and a fine fraction and the process includes the step of screening said cooled shale and returning only said coarse fraction to the top of the vertical shaft furnace whereby the gas flow permeability of the combined burden of hot oil depleted shale and cooled, spent shale is enhanced.

3. The process of claim 2 wherein the steps of charging hot, oil depleted shale to the top of said vertical shaft furnace and of returning at least a portion of said cooled, spent shale to the top of the vertical shaft furnace are alternated to form alternating layers of hot oil depleted shale and cooled spent shale.

4. The process of claim 1 wherein the portion of the cooled spent shale returned to the top of the furnace is sufficient to limit the peak combustion temperature to about 1200° F.

5. The process of claim 2 wherein the portion of the cooled spent shale returned to the top of the furnace is sufficient to limit the peak combustion temperature to about 1200° F.

6. The process of claim 4 wherein the combustion of the residual carbon in the upper portion of the furnace is an autogenous process.

7. The process of claim 1 wherein the step of recovering heat energy from said hot spent shale comprises introducing said recycle gas into the bottom portion of said vertical shaft furnace for ascendant passage therethrough and countercurrent contact with said hot spent shale, and withdrawing said heated recycle gas from an intermediate portion of said vertical shaft furnace together with the combustion gases.

8. The process of claim 1 wherein the step of recovering heat energy from said hot spent shale comprises introducing an inert gas into the bottom portion of said vertical shaft furnace for ascendant passage therethrough and countercurrent contact with said hot spent shale to heat said inert gas and cool said hot spent shale, withdrawing the hot inert gas from an intermediate portion of said vertical shaft furnace, circulating the hot inert gas and the recycle gas through a heat exchanger to heat said recycle gas, and returning the inert gas to the bottom portion of the vertical shaft furnace.

9. A process for the direct heating of recycle gas for the indirect retorting of oil from fresh oil shale after the oil has been recovered from the recycle gas, utilizing the residual carbon in hot, oil depleted shale, said process comprising the steps of:

charging said hot oil depleted shale into the top of a vertical shaft furnace for descending passage therethrough;

supplying sufficient air to said vertical shaft furnace for the combustion of the residual carbon in said hot, oil depleted shale in the upper portion of said vertical shaft furnace;

feeding said recycle gas into the bottom of said vertical shaft furnace for ascendant passage therethrough and countercurrent contact with the oil depleted shale further heated during carbon combustion, to recover heat therefrom and cool said oil depleted shale in the lower portion of said vertical shaft furnace;

returning at least a portion of said cooled, oil depleted shale from the bottom of said vertical shaft furnace to the upper portion thereof for heat absorption during the combustion of the carbon content of the oil depleted shale in order to moderate the temperature of combustion; and recovering the heated recycle gas from the lower portion of said vertical shaft furnace and combustion gases from the upper portion thereof at an intermediate portion of said furnace for use in the retorting of oil from fresh oil shale.

10. A process for the indirect heating of recycle gas for indirect retorting of oil from fresh oil shale after the oil has been recovered from the recycle gas, utilizing the residual carbon in hot oil depleted shale, said process comprising the steps of:

charging said hot oil depleted shale into the top of a vertical shaft furnace for descending passage therethrough;

supplying sufficient air to said vertical shaft furnace for the combustion of the residual carbon in said hot oil depleted shale in the upper portion of said vertical shaft furnace;

feeding an inert gas into the bottom of said vertical shaft furnace for ascending passage therethrough and concurrent contact with the oil and carbon depleted shale further heated during carbon combustion, to recover heat therefrom and cool said oil and carbon depleted shale in the lower portion of said vertical shaft furnace;

returning at least a portion of said cooled, oil and carbon depleted shale from the bottom of said vertical shaft furnace to the upper portion thereof for heat absorption during the combustion of the carbon content of the oil depleted shale in order to moderate the temperature of combustion; and recovering the heated inert gas from the lower portion of said vertical shaft furnace and the combustion products from the upper portion thereof at an intermediate portion of said furnace, circulating them through a heat exchanger to heat recycle gas for use in retorting oil from fresh shale, and returning the cooled gases to the bottom of the furnace as inert gas.

* * * * *